US006585450B2

(12) United States Patent
Meyers et al.

(10) Patent No.: US 6,585,450 B2
(45) Date of Patent: Jul. 1, 2003

(54) SPEED CONTROLLED ECCENTRIC ASSEMBLY

(75) Inventors: Kent Meyers, Chambersburg, PA (US); Steve K. Yates, Scotland, PA (US)

(73) Assignee: Ingersoll-Rand Company

( * ) Notice: Subject to any disclaimer, the term of this patent is extended or adjusted under 35 U.S.C. 154(b) by 12 days.

(21) Appl. No.: 09/901,840

(22) Filed: Jul. 10, 2001

(65) Prior Publication Data

US 2003/0012602 A1 Jan. 16, 2003

(51) Int. Cl.[7] ..... E01C 19/26
(52) U.S. Cl. ..... 404/117; 404/122; 404/130
(58) Field of Search ..... 404/117, 122, 404/130

(56) References Cited

U.S. PATENT DOCUMENTS

| | | | | |
|---|---|---|---|---|
| 2,481,174 A | | 9/1949 | Strawn | |
| 2,989,869 A | * | 6/1961 | Hanggi | 404/113 |
| 3,822,604 A | * | 7/1974 | Grimmer | 198/762 |
| 3,867,073 A | | 2/1975 | Barrett et al. | |
| 3,896,677 A | | 7/1975 | Larson | |
| 4,033,193 A | | 7/1977 | Brander | |
| 4,176,983 A | | 12/1979 | Gardner | |
| 4,341,126 A | * | 7/1982 | Thomas | 209/367 |
| 4,342,523 A | | 8/1982 | Salani | |
| 4,367,054 A | | 1/1983 | Salani et al. | |
| 4,550,622 A | | 11/1985 | La Bonte et al. | |
| 4,561,319 A | * | 12/1985 | Lilja | 404/117 |
| 4,568,218 A | * | 2/1986 | Orzal | 404/117 |
| 4,749,305 A | * | 6/1988 | Brown et al. | 366/116 |
| 4,759,659 A | * | 7/1988 | Copie | 366/125 |
| 4,830,534 A | | 5/1989 | Schmelzer et al. | |
| 5,934,824 A | * | 8/1999 | Vural | 404/117 |

FOREIGN PATENT DOCUMENTS

| | | |
|---|---|---|
| DE | 100 31 617 A1 | 1/2002 |
| FR | 1601552 | 8/1970 |

* cited by examiner

*Primary Examiner*—Robert E. Pezzuto
*Assistant Examiner*—Raymond W. Addie
(74) *Attorney, Agent, or Firm*—Michael Best & Friedrich LLP

(57) ABSTRACT

The eccentric assembly includes a tubular section, an eccentric weight, and a counterweight. The eccentric weight is mounted within the tubular section such that as a motor rotates the eccentric assembly, the eccentric weight generates vibrations that are transferred to the drum assembly of the vibration compacting machine. The counterweight is slidably coupled to the eccentric weight and moves between a first position where the counterweight contacts the eccentric weight and a second position where the counterweight contacts the tubular section.

17 Claims, 6 Drawing Sheets

SPEED CONTROLLED ECCENTRIC ASSEMBLY

BACKGROUND

This invention relates to vibration compacting machines, and more particularly to an eccentric assembly for a vibration compacting machine.

Vibration compacting machines are used in leveling paved or unpaved ground surfaces. A typical vibration compacting machine includes an eccentric assembly for generating vibrations that are transferred to a drum assembly of the compacting machine. The eccentric assembly commonly includes one or more eccentric weights that are adjustable between a plurality of discrete radial positions relative to a shaft in order to vary the amplitude of the vibrations that are generated by rotating the eccentric weight (s) about the shaft.

One such device includes a plurality of eccentric weights that are fixed to the shaft and a corresponding number of counterweights that are coupled to the opposite side of the shaft relative to the eccentric weights. The counterweights are moveable between a retracted position and a projected position relative to the longitudinal axis of the shaft. When the counterweights are in the retracted position their effect on the eccentric weights is minimized, resulting in maximum vibration amplitude being generated by the eccentric weights. The counterweights are normally biased toward the retracted position, however as the shaft rotates the biasing force is overcome and the counterweights are moved to the projected position where the counterweights are further away from the shaft. As the counterweights move further from the shaft, the counterweights reduce the effect of the eccentric weights resulting in a lower vibration amplitude.

One type of adjustable eccentric assembly operates by varying the rotational speed of the shaft. The eccentric assembly includes one or more eccentric weights that are biased toward the shaft. During operation of the eccentric assembly the shaft rotates, and as the rotational speed of the shaft increases, a centrifugal force overcomes the biasing force and causes the eccentric weight to move away from the shaft. The vibration amplitude increases as the eccentric weights move away from the shaft.

SUMMARY OF THE INVENTION

The present invention is directed to an eccentric assembly for a vibration compacting machine. Rotating the eccentric assembly generates vibrations that are transferred to the drum assembly of the vibration compacting machine.

The eccentric assembly of the present invention generates vibrations that have a lower amplitude at high rotational speeds (i.e., frequencies). Reducing vibration amplitude at higher shaft speeds minimizes wear to each of the load bearing components in the vibration compacting machine, resulting in an extended service life for the vibration compacting machine. The eccentric assembly of the present invention is also easily and inexpensively manufactured, can be readily adapted to be used in existing vibration compacting machines and encases all critical moving components within a protective tubular section.

The eccentric assembly includes a tubular section, an eccentric weight, and a counterweight. The eccentric weight is mounted within the tubular section such that as a motor rotates the eccentric assembly, the eccentric weight generates vibrations that are transferred to the drum assembly of the vibration compacting machine. The eccentric assembly also includes a counterweight that is slidably coupled to the eccentric weight. The counterweight moves over a range between a first position where the counterweight contacts the eccentric weight and a second position where the counterweight contacts the tubular section.

During operation of the vibration compacting machine, the eccentric assembly generates a maximum moment of eccentricity about an axis of rotation when the counterweight is in contact with the eccentric weight (i.e., the first position). As the rotational speed of the eccentric assembly increases, the eccentric weight and the counterweight are separated and the moment of eccentricity generated by the rotating eccentric assembly decreases.

The counterweight is preferably biased toward the first position by a spring. The counterweight will remain in the first position until the eccentric assembly is rotated at a sufficient speed to create a centrifugal force on the counterweight that overcomes the biasing force generated by the spring. Once the centrifugal force is larger than the biasing force, the counterweight moves toward the second position, thereby lowering the moment of eccentricity and decreasing the vibration amplitude.

Other features and advantages of the invention will become apparent to those skilled in the art upon review of the following detailed description, claims, and drawings.

DETAILED DESCRIPTION

Figure 1:
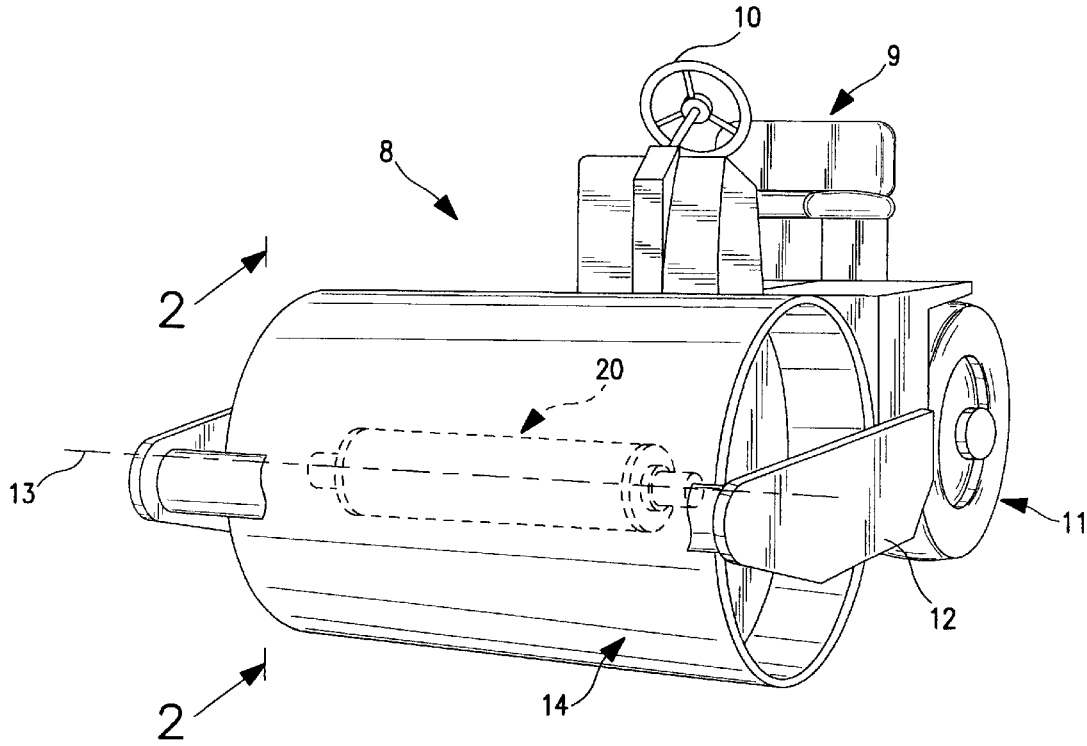
FIG. 1 is an isometric view of a vibration compacting machine including an eccentric assembly of the present invention.

Before explaining the invention in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

FIG. 1 illustrates a vibration compacting machine 8 according to the present invention. The vibration compacting machine 8 is used in leveling paved or unpaved ground surfaces. The vibration compacting machine 8 includes a frame 12 and at least one drum assembly 14 mounted to one end of the frame 12 for rotation about a longitudinal axis 13. The opposite end of the frame 12 generally has a wheel assembly 11 or a second drum assembly (not shown) that, with drum assembly 14, supports the frame 12 for movement over the ground surface. An operator's station 9, including a steering wheel 10 or the like, is provided on the frame 12 for driving and operation of the compacting machine 8. These features of the vibration compacting machine 8 are known in the art.

Figure 2:
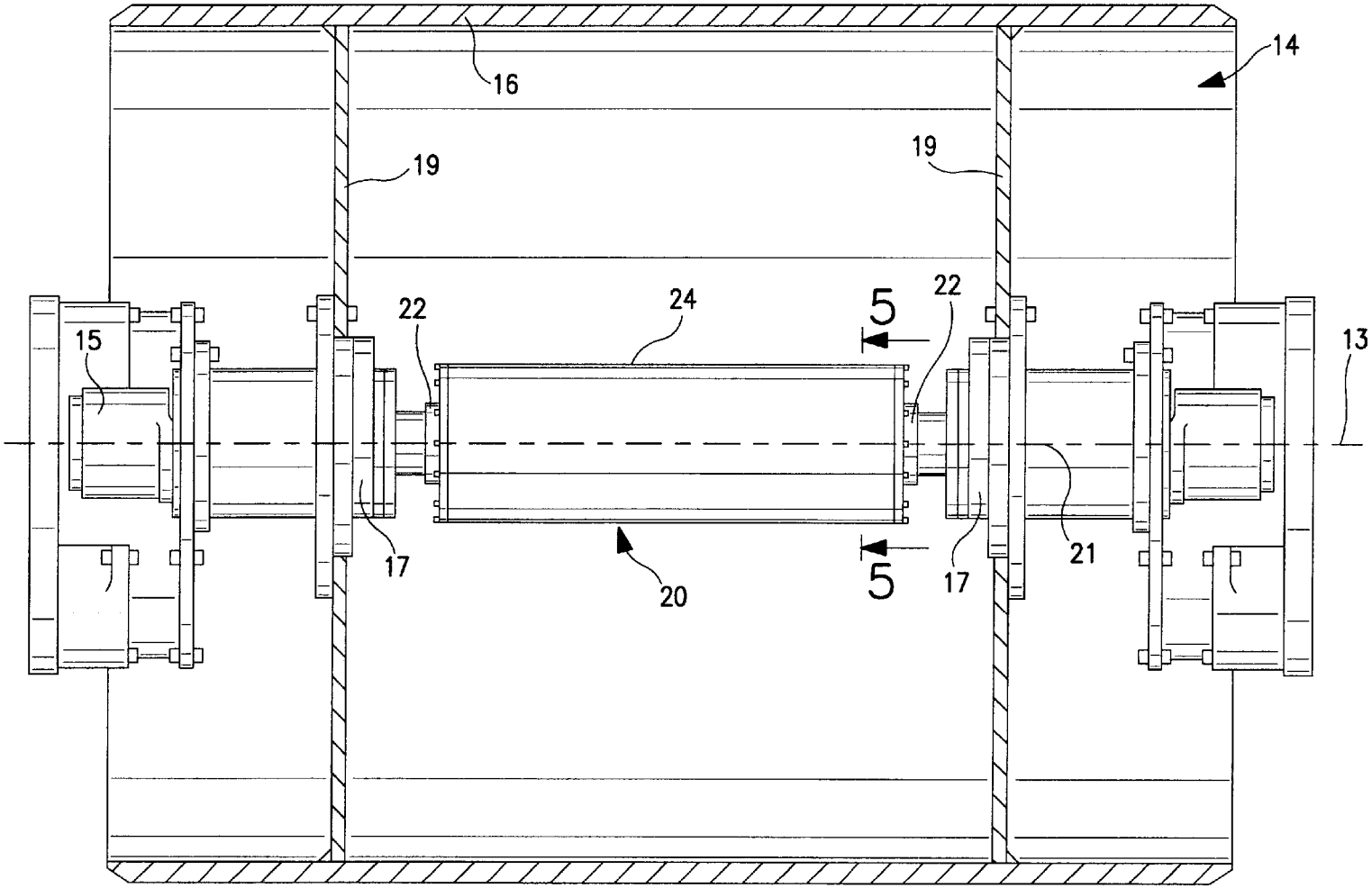
FIG. 2 is a section view of a drum assembly of the vibration compacting machine illustrated in FIG. 1 taken along line 2—2.
Figure 3:
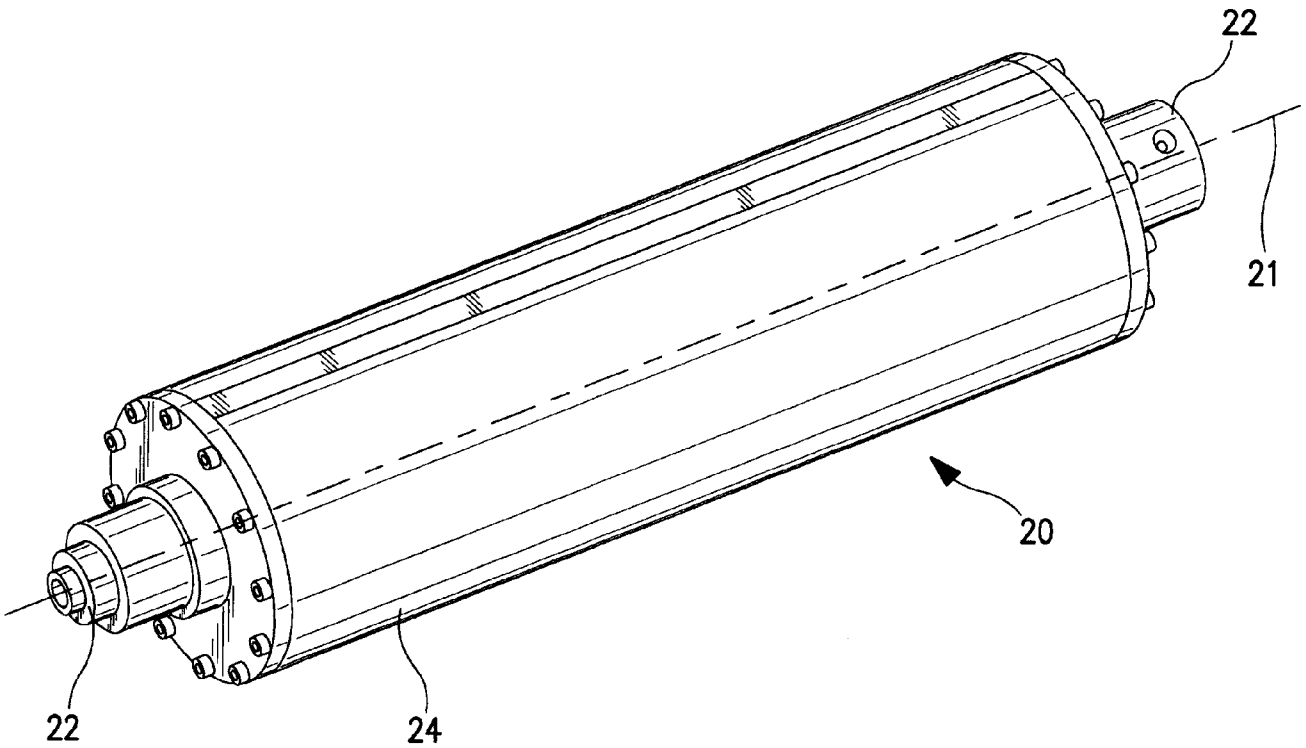
FIG. 3 is an isometric view of an eccentric assembly of the present invention.

Referring now also to FIG. 2, the drum assembly 14 includes a drum 16 and an eccentric assembly 20 that is mounted for rotation relative to the drum 16. The eccentric assembly 20 rotates about an axis of rotation 21 that is substantially aligned with the longitudinal axis 13 of the drum assembly 14. The eccentric assembly 20 includes a moment of eccentricity such that rotation of the eccentric assembly 20 by a motor 15 creates vibrations that are transferred through the drum 16 to the ground.

The preferred eccentric assembly 20 includes two flanged journals 22 at the ends of a tubular section 24. The flanged journals 22 are coupled to bearings 17 (shown only in FIG. 2) at each end of the eccentric assembly 20. The bearings 17 are secured to parallel supports 19, preferably circular plates, mounted in and extending across the inner diameter of the drum 16. The supports 19 are welded to an interior wall of the drum 16 and are generally perpendicular to the longitudinal axis 13 of the drum 16. The motor 15 rotates the flanged journals 22 about the axis of rotation 21 such that the eccentric assembly 20 generates vibrations that are transferred to the drum 14.

Figure 4:
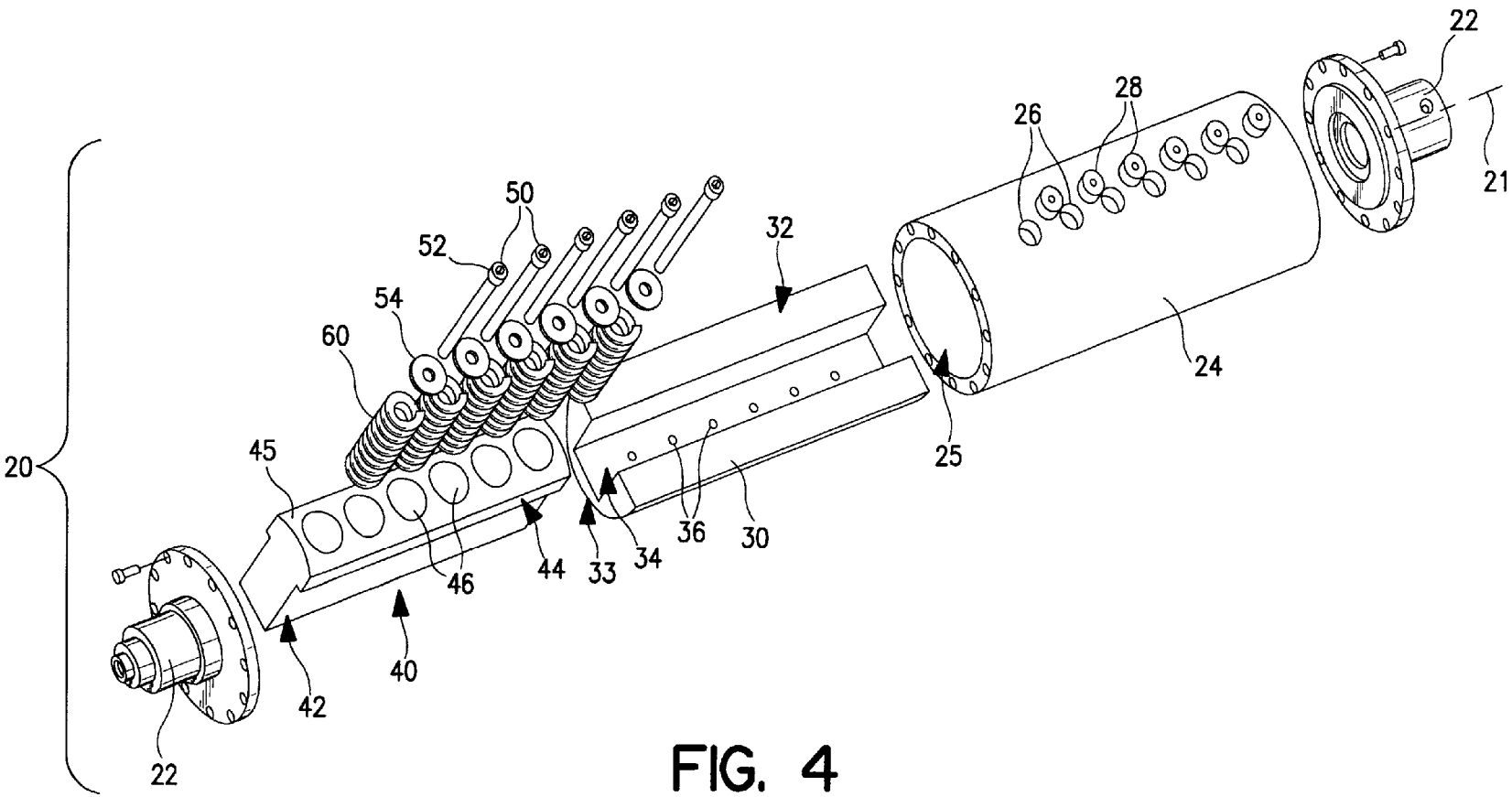
FIG. 4 is an exploded isometric view of the eccentric assembly illustrated in FIG. 3.

Referring to FIGS. 3–7, the tubular section 24 is mounted at each end to the flanged journals 22 using fasteners that are configured in a circular bolt pattern. The tubular section 24 is mounted to the flanged journals 22 such that the central axis of the tubular section 24 is substantially aligned with the axis of rotation 21 of the eccentric assembly 20. The tubular section 24 is preferably cylindrically shaped and contains cylindrical or concave inner surface 25 that extends along its length. As best seen in FIG. 4, a plurality of fastener securing bores 26, with corresponding caps 28, the function of which will be described hereinafter, are provided through the tubular section 24 on one side of the axis 21. The tubular section 24 is independently mountable and rotatable irrespective of the configuration of the eccentric weight 30 or counterweight 40.

Figure 6:
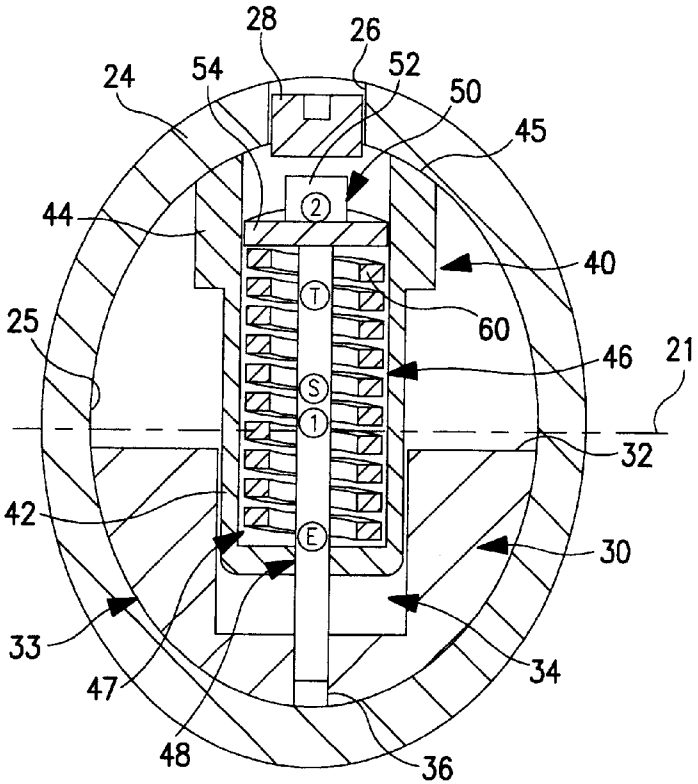
FIG. 6 is a section view similar to FIG. 5, illustrating the eccentric assembly in a dynamic condition.
Figure 5:
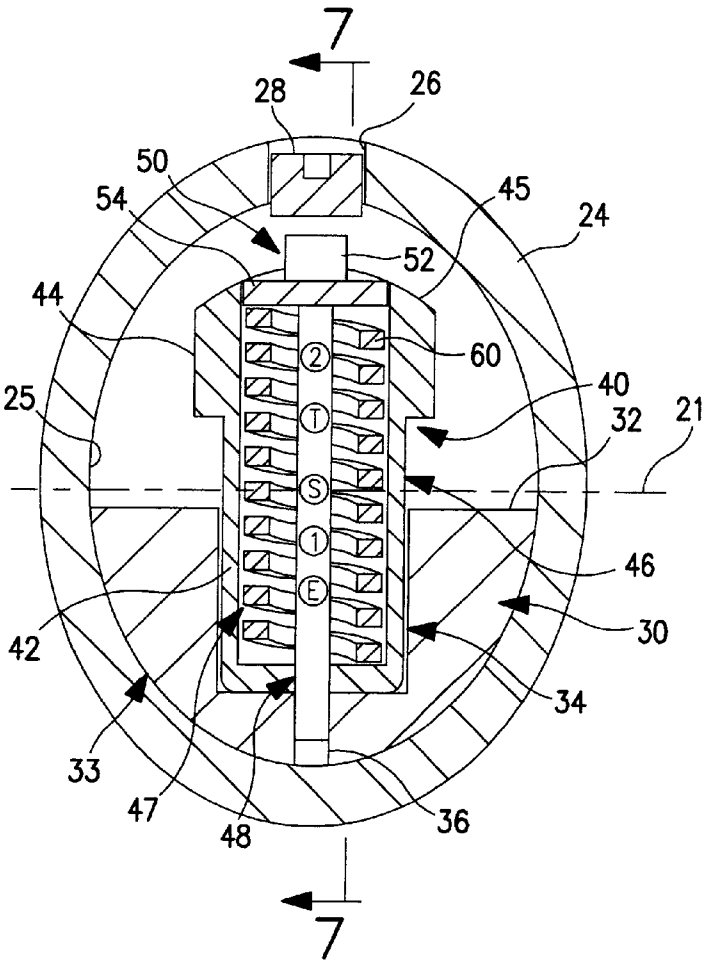
FIG. 5 is a section view taken along line 5—5 in FIG. 2, illustrating the eccentric assembly in a static condition.
Figure 7:
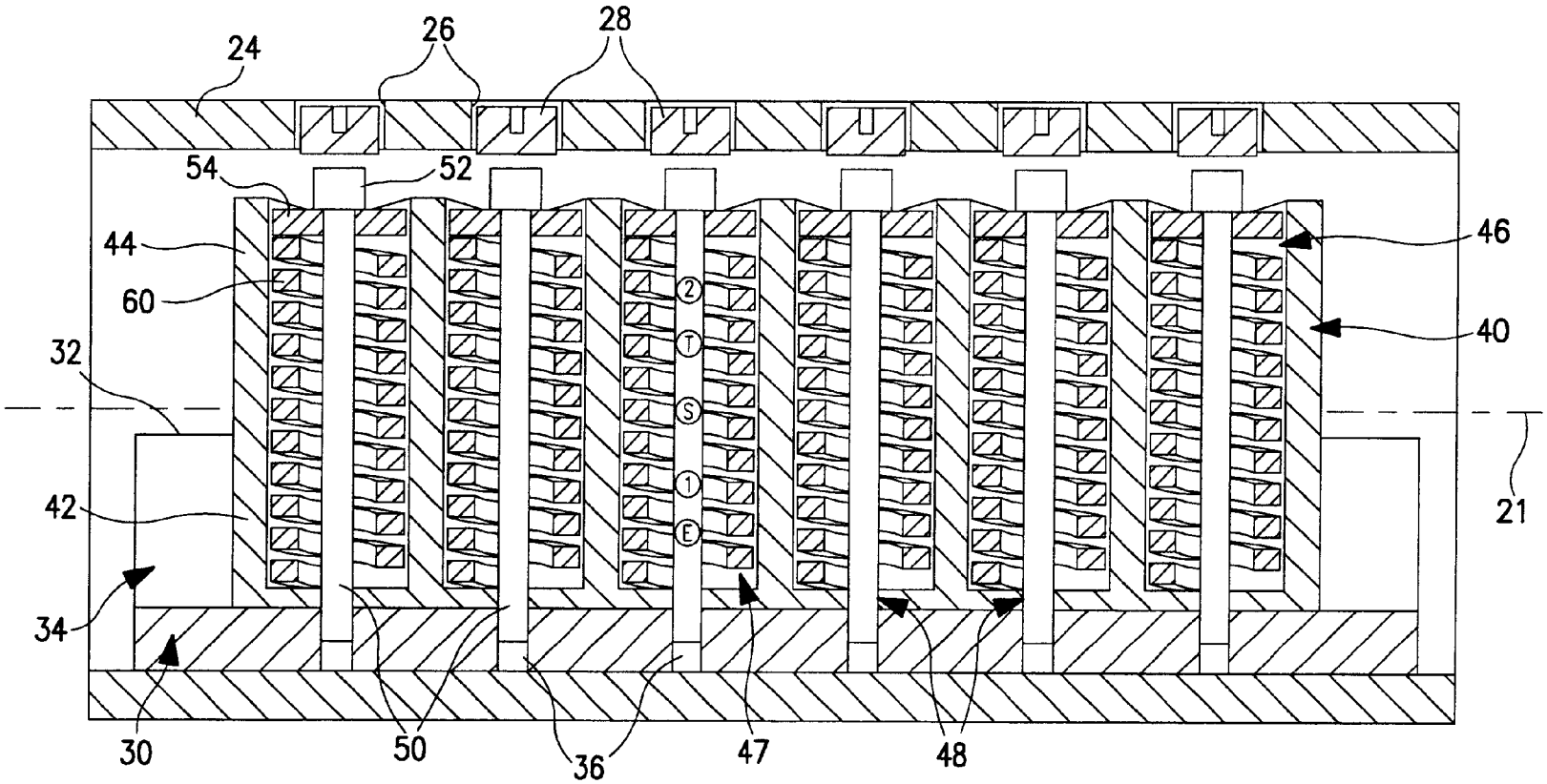
FIG. 7 is a section view taken along line 7—7 in FIG. 5.

Referring now particularly to FIGS. 4–7, eccentric assembly 20 also includes an eccentric weight 30, a counterweight 40, a plurality of fasteners 50 and a plurality of biasing members 60. The eccentric weight 30 is fixed within the tubular section 24 such that a center of gravity Ⓔ of the eccentric weight 30 is located on a first side of the axis of rotation 21 (below the axis 21 in FIGS. 5–7). The first side of the axis of rotation 21 is preferably opposite the side of the axis of rotation 21 along which the fastener securing bores 26 are provided (hereinafter referred to as the second side of the axis 21, which is above the axis 21 in FIGS. 5–7). The eccentric weight 30 is preferably semi-cylindrical and extends along a substantial length of the tubular section 24. The eccentric weight 30 includes a generally planar first surface 32 and a convex or semi-cylindrical outer surface 33. The eccentric weight 30 is fixed within the tubular section 24 such that the first surface 32 is along or on the first side of the axis of rotation 21. In other words, as seen in FIGS. 5 and 6, the surface 32 defines a chord of the tubular section 24. The eccentric weight 30 may be permanently fixed, for example, via welding, or may be releasably secured, for example, via screws (not shown), to allow easy interchanging thereof.

The convex surface 33 is similar in curvature to the inner surface 25 of the tubular section 24 such that substantially the entire surface 33 is positioned against substantially the entire surface 25. The first surface 32 of the weight 30 preferably has a rectangular cavity 34 extending along its length. The cavity 34 is configured to receive a portion of the counterweight 40 as will be described hereinafter. As best seen in FIG. 4, a plurality of fastener receiving bores 36 are provided along the bottom surface of the cavity 34.

The counterweight 40 has a center of gravity Ⓣ and first and second portions 42 and 44. The first portion 42 is configured to be received within the eccentric weight cavity 34 and has a center of gravity ① which is on the first side of (below) the axis 21 when the first portion 42 is received fully in the cavity 34 (FIG. 5). The second portion 44 has a second portion center of gravity ② and is configured such that the centers of gravity Ⓣ and ② are both located on second side of (above) the axis of rotation 21 at all times. The second portion 44 of the counterweight 40 also includes a convex surface 45 that extends along the entire length of the counterweight 40 and substantially defines a semi-cylindrical shape that is similar in curvature to the inner surface 25 of the tubular section 24.

The counterweight 40 is slidably coupled to the eccentric weight 30 by at least one fastener 50 extending through a bore 46 in the counterweight 40. As shown in FIGS. 4–7, a plurality of bores 46 are preferably provided, each bore 46 having a large-diameter receiving section 47 and a small-diameter through section 48. The receiving section 47 is configured to receive and maintain one of the biasing members 60 positioned therein. A shoulder member 54 or washer is positioned over the biasing member 60 adjacent the open end of the bore 46. The shoulder member 54 is preferably sized to substantially close the open end of the bore 46 to reduce passage of lubricants or debris that may be present in the tubular section 24. Since material will generally move to the eccentric weight 30 side of the tubular section 24 when the assembly 20 is at rest and to the tubular section internal surface 25 when the assembly 20 is rotating, a sealing fit is generally not required of the shoulder member 54, but such may be provided. The biasing members 60 are preferably compression springs, but other structures, for example, an elastomeric material or a semi-compressible fluid, may also be used. In the case of a fluid, the shoulder members 54 would provide a sealing fit to prevent leakage of such fluid.

To couple the counterweight 40 to the eccentric weight 30, a fastener 50, preferably a threaded bolt, is inserted through the shoulder member 54, the biasing member 60 and the through section 48 and secured in a corresponding eccentric weight threaded bore 36. While threaded bolts and corresponding threaded bores are preferred, other types of fastening arrangements, for example, a ratchet fit rod and catch, may also be used. Since the counterweight 40 is coupled to the eccentric weight 30 as an independent structure and the tubular section 24 is independent of such structure, the eccentric weight 30 and counterweight 40 structure can easily be changed by detaching the eccentric weight 30 from the tubular section 24, for example, by removing securing screws, and securing a different eccentric weight 30 and counterweight 40 structure within the tubular section 24.

Each fastener 50 has a head portion 52 which overlies a portion of the shoulder member 54 such that tightening of the fastener 50 compresses the biasing member 40 within the receiving portion 47 of the bore 46. The counterweight 40 is thereby biased toward a first position (FIG. 5) wherein the counterweight first portion 42 is received fully in the eccentric weight cavity 34. Tightening or loosening of the fastener 50 controls the compression, and corresponding biasing force, of the biasing member 60. The counterweight 40 is moveable over a range between the first position (FIG. 5) and a second position (FIG. 6) wherein the convex surface 45 of the counterweight 40 is in contact with the inner surface 25 of the tubular section 24.

It should be noted that the inner surface 25 of the tubular section 24 and the outer surface 33 of the eccentric weight 30 are preferably in substantially surface contact along their length. The convex surface 45 of the counterweight 40 and the inner surface 25 of the tubular section 24 are also preferably in surface contact when the counterweight 40 is in the second position. However, point or line contact between any of these surface pairs is possible. Furthermore, it is not required that the eccentric weight 30 and/or the counterweight 40 be manufactured as one continuous piece. The eccentric weight 30 and the counterweight 40 may consist of a plurality of smaller individual weights distributed along the length of the tubular section 24.

During operation of the eccentric assembly 20, the eccentric weight 30 and the counterweight 40 are initially in the first position (FIG. 5) with the biasing members 60 maintaining the first portion 42 of the counterweight 40 received fully within the cavity 34 of the eccentric weight 30. In the first position, the eccentric weight and counterweight first portion centers of gravity Ⓔ and ① are on the first side of (below) the axis 21 and the counterweight second portion and overall centers of gravity ② and Ⓣ are at their closest position relative to the axis 21 such that the eccentric assembly 20 has a maximum moment of eccentricity. It will also be seen in FIG. 5 that in the first position, the biasing member 60 extends between both sides of the tubular section and thereby has a center of gravity Ⓢ proximate the axis of rotation 21. As a result, in the first position, the biasing member 60 has a minimal effect on the moment of eccentricity.

As the motor 15 begins rotating the flanged journals 22, the eccentric assembly 20 generates vibrations that are transferred to the drum assembly 14 of the vibration compacting machine 8. The eccentric assembly 20 operates in either direction of rotation, however, there is a performance advantage when the rotational direction of the eccentric assembly 20 coincides with the rotational direction of the drum 16.

Rotation of the eccentric assembly 20 generates a centrifugal force on the counterweight 40 that urges the counterweight 40 to move away from the eccentric weight 30 (upward in FIGS. 5 and 6). When the eccentric assembly 20 is rotated at a sufficient speed, the centrifugal force acting on the counterweight 40 overcomes the biasing force provided by the biasing members 60 such that the counterweight 40 compresses the biasing members 60 and slides along the fasteners 50 away from the first position. As explained above, the fasteners 60 can be tightened or loosened to define the biasing force and thereby the force which must be overcome to begin movement of the counterweight 40. Such calibration of the fasteners 60 can be performed before installation of the eccentric weight 30 and counterweight 40 in the tubular section 40. Alternatively, the fasteners 60 can be accessed through the fastener securing bores 26 to perform field calibrations and the like. After calibration is performed through the bores 26, caps 28 are preferably inserted into the bores 26 to sealingly close such and prevent leakage of oil or other lubrication (not shown) preferably contained in the tubular section 24.

As the counterweight 40 moves away from the eccentric weight 20, the counterweight 40 both reduces and offsets the maximum moment of eccentricity, i.e.—as the first portion center of gravity ① moves toward the axis 21, the maximum moment of eccentricity is reduced and as the second portion and overall centers of gravity ② and Ⓣ move further from the axis 21, the maximum moment of eccentricity is further offset by the counterweight 40. Additionally, referring to FIG. 6, the biasing member center of gravity Ⓢ also moves to the second side of (above) the axis 21 to also further offset the maximum moment of eccentricity. As the speed of the eccentric assembly 20 continues to increase, the counterweight 40 eventually moves a maximum distance away from the eccentric weight 30 (FIG. 6) where the convex surface 36 of the counterweight 40 is in contact with the inner surface 25 of the tubular section 24.

When the counterweight 40 is the maximum distance from the eccentric weight 30, the eccentric assembly 20 has a minimum moment of eccentricity. A lower moment of eccentricity about the axis of rotation 21 generates vibrations with lower amplitudes. Therefore, the vibration amplitude generated by the eccentric assembly 20 when the counterweight 40 is in the second position is smaller than the vibration amplitude that is generated when the counterweight 40 is in the first position with a complete range of decreasing amplitude as the counterweight 40 moves from the first to the second position. The lower vibration amplitude at increased vibration frequencies reduces bearing wear and extends bearing life.

Accordingly, an operator can control the eccentric amplitude by increasing or decreasing the eccentric assembly rotational speed as desired.

What is claimed is:

1. An eccentric assembly for a vibration compacting machine, the eccentric assembly comprising:

a tubular section, the tubular section being independently rotatable about an axis;

an eccentric weight coupled within the tubular section and having a center of gravity on a first side of the axis and a cavity beginning on the first side of the axis and opening toward a second, opposite side of the axis, the eccentric weight includes a convex surface having a given curvature and the tubular section includes a concave surface having a given curvature, the curvature of the convex surface being substantially equal to the curvature of the concave surface; and a counterweight, having first and second portions, coupled with the eccentric weight, the counterweight having a total center of gravity and each portion having a portion center of gravity, the counterweight moveable relative to the eccentric weight over a range between a first position and a second position, the portions configured such that in the first position, the first portion extends into the cavity such that the first portion center of gravity is on the first side of the axis and the second portion center of gravity and the counterweight total center of gravity are on the second side of the axis;

whereby the eccentric assembly provides a variable range of eccentric amplitude as the counterweight moves over the range between the first and second positions.

2. The eccentric assembly of claim 1 further comprising a biasing member that generates a biasing force against the counterweight to bias the counterweight toward the first position.

3. The eccentric assembly of claim 2 wherein rotating the eccentric assembly at a sufficient speed creates a centrifugal force on the counterweight that overcomes the biasing force on the counterweight that is generated by the biasing member such that the counterweight moves over the range between the first position and the second position.

4. The eccentric assembly of claim 2 wherein the biasing member is a spring.

5. The eccentric assembly of claim 1 wherein the tubular section includes an interior chamber and the eccentric weight occupies substantially all of the interior chamber on the first side of the axis except for the cavity.

6. The eccentric assembly of claim 1 wherein the eccentric weight is removably coupled within the tubular section.

7. The eccentric assembly of claim 1 wherein the convex surface on the eccentric weight and the concave surface on the tubular section are in substantially surface contact.

8. The eccentric assembly of claim 1 wherein the counterweight includes a convex surface having a given curvature, the curvature of the convex surface on the counterweight being substantially equal to the curvature of the concave surface on the tubular section.

9. The eccentric assembly of claim 8 wherein in the first position the counterweight is in surface contact with the eccentric weight and in the second position engages the concave surface on the tubular section.

10. The eccentric assembly of claim 9 wherein the convex surface on the counterweight and the concave surface on the tubular section are in substantially surface contact.

11. An eccentric assembly for a vibration compacting machine, the eccentric assembly comprising:

a substantially closed tubular section having at least one sealable through bore and being rotatable about an axis;

an eccentric weight coupled within the tubular section and having a center of gravity on a first side of the axis;

a counterweight coupled within the tubular section and having a center of gravity on a second, opposite side of the axis, the counterweight moveable relative to the eccentric weight over a range between a first position and a second position;

a fastener extending from the eccentric weight, through the counterweight and including a head member that is aligned with the through bore;

a biasing member positioned about the fastener between the fastener head and the counterweight such that a biasing force biases the counterweight toward the first position, adjustment of the fastener through the through bore permitting adjustment of the biasing force; and a cap for sealingly closing the through bore.

12. The eccentric assembly of claim 11 wherein the fastener is a threaded bolt.

13. The eccentric assembly of claim 11 wherein a lubrication material is provided within the tubular section.

14. An eccentric assembly for a vibration compacting machine, the eccentric assembly comprising:

a substantially closed tubular section rotatable about an axis;

an eccentric weight coupled within the tubular section and having a center of gravity on a first side of the axis;

a counterweight coupled within the tubular section and having a bore of a given diameter, the counterweight having a center of gravity on a second, opposite side of the axis, the counterweight moveable relative to the eccentric weight over a range between a first position and a second position;

a fastener extending from the eccentric weight, through the counterweight and including a head member having a shoulder portion having a diameter substantially the same as the given diameter;

a biasing member positioned in the bore about the fastener between the fastener head member and the counterweight, the fastener tightened such that the shoulder is within the bore to substantially enclose the biasing member therein, the biasing member generating a biasing force that biases the counterweight toward the first position.

15. An eccentric assembly for a vibration compacting machine, the eccentric assembly comprising:

a substantially closed tubular section rotatable about an axis;

an eccentric weight coupled within the tubular section and having a center of gravity on a first side of the axis;

a counterweight coupled within the tubular section and having a bore of a given diameter, the counterweight having a center of gravity on a second, opposite side of the axis, the counterweight moveable relative to the eccentric weight over a range between a first position and a second position;

a fastener extending from the eccentric weight, through the counterweight and including a head member having a shoulder portion having a diameter substantially the same as the given diameter;

a biasing member positioned in the bore about the fastener between the fastener head member and the counterweight, the fastener tightened such that the shoulder is within the bore to substantially enclose the biasing member therein, the biasing member generating a biasing force that biases the counterweight toward the first position wherein the eccentric weight includes a cavity beginning on the first side of the axis and opening toward the second side of the axis and the counterweight has first and second portions with the bore extending into both portions, each portion and the biasing member having a center of gravity, the portions configured such that in the first position, the first portion extends into the cavity such that the first portion center of gravity is on the first side of the axis, the second portion center of gravity is on the second side of the axis and the biasing member center of gravity is along or on the first side of the axis.

16. The eccentric assembly of claim 14 wherein the fastener is adjustable and adjustment of the fastener adjusts the biasing force.

17. An eccentric assembly for a vibration compacting machine, the eccentric assembly comprising:

a substantially closed tubular section rotatable about an axis;

an eccentric weight coupled within the tubular section and having a center of gravity on a first side of the axis;

a counterweight coupled within the tubular section and having a bore of a given diameter, the counterweight having a center of gravity on a second, opposite side of the axis, the counterweight moveable relative to the eccentric weight over a range between a first position and a second position;

a fastener extending from the eccentric weight, through the counterweight and including a head member having a shoulder portion having a diameter substantially the same as the given diameter;

a biasing member positioned in the bore about the fastener between the fastener head member and the counterweight, the fastener tightened such that the shoulder is within the bore to substantially enclose the biasing member therein, the biasing member generating a biasing force that biases the counterweight toward the first position wherein the fastener is adjustable such that adjustment of the fastener adjusts the biasing force and the tubular section includes at least one sealable through bore aligned with the fastener for adjustment thereof.

* * * * *